US010174529B2

(12) United States Patent
Saitou et al.

(10) Patent No.: US 10,174,529 B2
(45) Date of Patent: Jan. 8, 2019

(54) HANDLE DEVICE FOR VEHICLE DOOR

(71) Applicant: KABUSHIKI KAISHA HONDA LOCK, Miyazaki-shi, Miyazaki (JP)

(72) Inventors: Tadashi Saitou, Miyazaki (JP); Kenichi Otsubo, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 0 days.

(21) Appl. No.: 14/906,677

(22) PCT Filed: May 21, 2014

(86) PCT No.: PCT/JP2014/063457
§ 371 (c)(1),
(2) Date: Jan. 21, 2016

(87) PCT Pub. No.: WO2015/011973
PCT Pub. Date: Jan. 29, 2015

(65) Prior Publication Data

US 2016/0160539 A1 Jun. 9, 2016

(30) Foreign Application Priority Data

Jul. 25, 2013 (JP) ..... 2013-154355

(51) Int. Cl.
*E05B 3/00* (2006.01)
*E05B 85/16* (2014.01)
(Continued)

(52) U.S. Cl.
CPC ..... *E05B 85/16* (2013.01); *E05B 81/76* (2013.01); *H01H 13/06* (2013.01);
(Continued)

(58) Field of Classification Search
CPC ..... E05B 85/16; E05B 81/76; H01H 13/06; H01H 2215/006; Y10T 292/57; Y10S 292/30; Y10S 292/31
(Continued)

(56) References Cited

U.S. PATENT DOCUMENTS 6,619,709 B1 9/2003 Monig et al.
6,626,473 B1 * 9/2003 Klein ..... B29C 45/1676 200/302.2
(Continued)

FOREIGN PATENT DOCUMENTS

CN 1371446 A 9/2002
CN 1594809 A 3/2005
(Continued)

OTHER PUBLICATIONS

Official Communication dated Dec. 13, 2016 to corresponding Chinese Patent Application No. 201480041334.1.
(Continued)

*Primary Examiner* — Kristina R Fulton
*Assistant Examiner* — Faria F Ahmad
(74) *Attorney, Agent, or Firm* — Carrier Blackman & Associates, P.C.; William D. Blackman; Joseph P. Carrier

(57) ABSTRACT

A handle device for a vehicle door is provided in which a tact switch that can switch between switching modes in response to a pressing-in operation of an operating button is housed and fixed within a housing recess of a handle main body so as to be electrically connected to printed wiring of a board. The printed wiring is disposed at a different site from one face, facing a cover member side, of the board, the tact switch which is fixed to the one face of the board is electrically connected to the printed wiring, a flange portion abutting against the one face of the board is provided integrally with a switch cover covering the tact switch and
(Continued)

connected to the operating button, and the push-in stroke of the operating button is restricted to a predetermined value or below with a hold-down member engaged with the handle main body.

7 Claims, 7 Drawing Sheets

(51) Int. Cl.
*E05B 81/76* (2014.01)
*H01H 13/06* (2006.01)

(52) U.S. Cl.
CPC ..... *H01H 2215/006* (2013.01); *Y10S 292/30* (2013.01); *Y10S 292/31* (2013.01)

(58) Field of Classification Search
USPC ..... 292/336.3, DIG. 30, DIG. 31
See application file for complete search history.

(56) References Cited

U.S. PATENT DOCUMENTS

| | | | | |
|---|---|---|---|---|
| 6,768,070 | B2 * | 7/2004 | Lewison | H01H 13/06 200/296 |
| 7,057,124 | B2 * | 6/2006 | Ieda | E05B 81/76 200/520 |
| 7,273,991 | B2 | 9/2007 | Korultay et al. | |
| 7,819,442 | B2 * | 10/2010 | Ieda | B60R 25/24 292/336.3 |
| 8,044,313 | B2 * | 10/2011 | Yamamoto | B62K 11/14 200/314 |
| 8,237,072 | B2 * | 8/2012 | Kubota | E05B 81/76 200/296 |
| 8,469,412 | B2 | 6/2013 | Mizushima et al. | |
| 8,575,506 | B2 * | 11/2013 | Kitahara | H01H 13/06 200/302.2 |
| 9,099,262 | B2 * | 8/2015 | Satou | E05B 81/76 |
| 2005/0077737 | A1 * | 4/2005 | Komiyama | E05B 81/78 292/336.3 |
| 2008/0290671 | A1 | 11/2008 | Kagawa et al. | |
| 2010/0077567 | A1 | 4/2010 | Makino et al. | |
| 2010/0078947 | A1 | 4/2010 | Makino et al. | |
| 2010/0187838 | A1 * | 7/2010 | Ieda | B60R 25/00 292/336.3 |
| 2011/0012378 | A1 * | 1/2011 | Ueno | B29C 45/14811 292/336.3 |
| 2011/0179602 | A1 | 7/2011 | Fujiwara et al. | |
| 2012/0133159 | A1 * | 5/2012 | Tateishi | E05B 81/77 292/336.3 |
| 2012/0167642 | A1 | 7/2012 | Savant et al. | |
| 2013/0048482 | A1 | 2/2013 | Saitou | |
| 2014/0246873 | A1 * | 9/2014 | Raulin | E05B 81/77 292/336.3 |

FOREIGN PATENT DOCUMENTS

| | | | |
|---|---|---|---|
| CN | 101684694 | A | 3/2010 |
| CN | 101684695 | A | 3/2010 |
| DE | 10 2006 010 811 | A1 | 9/2007 |
| DE | 10 2007 060 182 | A1 | 6/2009 |
| JP | 2004-169427 | A | 6/2004 |
| JP | 2004-324098 | A | 11/2004 |
| JP | 2007-270516 | A | 10/2007 |
| JP | 2013-051038 | A | 3/2013 |
| WO | 2005/008003 | A1 | 1/2005 |
| WO | 2008108472 | A1 | 9/2008 |
| WO | 2011/061281 | A2 | 5/2011 |

OTHER PUBLICATIONS

Extended European search report dated Feb. 28, 2017, issued in the corresponding EP Patent Application 14829055.4.

* cited by examiner

HANDLE DEVICE FOR VEHICLE DOOR

TECHNICAL FIELD

The present invention relates to a handle device for a vehicle door in which a vehicle door is provided with an operating handle that includes a handle main body having a housing recess for housing and fixing a board having an electronic component mounted thereon, and a cover member joined to the handle main body so as to cover the housing recess, a tact switch that can switch between switching modes in response to a pressing-in operation of an operating button looking out on an outer surface of the cover member is housed and fixed within the housing recess so as to be electrically connected to printed wiring of the board, and an interior of the housing recess is filled with a potting material.

BACKGROUND ART

A handle device for a vehicle door in which a tact switch is fixed to a tact switch holder fixed within a housing recess of a handle main body at a position separated from a board housed and fixed within the housing recess and printed wiring of the board is electrically connected to the tact switch via a lead is known from Patent Document 1.

RELATED ART DOCUMENTS

Patent Documents

Patent Document 1: Japanese Patent Application Laid-open No. 2004-169427

SUMMARY OF THE INVENTION

Problems to be Solved by the Invention

However, in the arrangement disclosed in Patent Document 1 above, it is necessary to solder the lead extending from the board to the tact switch so as to connect them and cover the connected portion with a potting material, the number of assembly steps is large, and the assembly operation is also complicated. Moreover, since it is necessary to ensure that there is space for routing the lead within the housing recess, there is a possibility that the operating handle will increase in size, and there are restrictions in terms of design.

The present invention has been accomplished in light of such circumstances, and it is an object thereof to provide a handle device for a vehicle door that reduces the number of assembly steps, simplifies the assembly operation, reduces the size of an operating handle, and enhances the degree of freedom in design.

Means for Solving the Problems

In order to attain the above object, according to a first aspect of the present invention, there is provided a handle device for a vehicle door in which a vehicle door is provided with an operating handle comprising a handle main body having a housing recess for housing and fixing a board having an electronic component mounted thereon, and a cover member joined to the handle main body so as to cover the housing recess, a tact switch that can switch between switching modes in response to a pressing-in operation of an operating button looking out on an outer surface of the cover member is housed and fixed within the housing recess so as to be electrically connected to printed wiring of the board, and an interior of the housing recess is filled with a potting material, characterized in that the tact switch, which is fixed to one face, facing the cover member side, of the board, is electrically connected to the printed wiring, which is disposed at a different site from the one face of the board, a flange portion extending endlessly so as to surround, from the periphery, the tact switch and a site where the tact switch is connected to the printed wiring and abutting against the one face of the board is provided integrally with a switch cover, made of an elastic material, covering the tact switch while being connected to the operating button so as to transmit a pushing force to the tact switch in response to a pushing operation of the operating button, and a hold-down member sandwiching the flange portion between itself and the board and restricting the push-in stroke of the operating button to a predetermined value or below is engaged with the handle main body from the board side.

Further, according to a second aspect of the present invention, in addition to the first aspect, the hold-down member, which is made of a synthetic resin, is formed so as to integrally have a hold-down member main portion that is formed into a tubular shape while having on opposite end parts a hold-down face abutting against the entire periphery of the flange portion and a restricting face opposing the operating button in order to restrict the push-in stroke of the operating button and housing the part of the switch cover other than the flange portion, and an engagement claw that is integrally and connectedly provided at a plurality of locations in a peripheral direction of an outer periphery of the hold-down member main portion so as to resiliently engage with a latching projection provided on the handle main body, and a positioning part is formed on at least one of the latching projection and the engagement claw, the positioning part determining a fixed relative position between the engagement claw and the latching projection when the hold-down member is inserted into the housing recess so as to engage with the handle main body.

According to a third aspect of the present invention, in addition to the second aspect, an annular projection biting into the flange portion so as to surround the tact switch is provided integrally with the hold-down member so as to project from the hold-down face, and a restricting wall extending endlessly while surrounding the restricting face so as to prevent the potting material, with which the housing recess is filled, from flowing in between the operating button and the restricting face is provided integrally with the hold-down member so as to project from the outer periphery of the restricting face toward the operating button side.

Moreover, according to a fourth aspect of the present invention, in addition to the second or third aspect, a base end part of an arm portion forming a U-shaped groove between itself and the hold-down member main portion is integrally and connectedly provided on the hold-down member main portion, and the engagement claw is formed integrally with an extremity of the arm portion.

Effects of the Invention

In accordance with the first aspect of the present invention, since the tact switch is fixed to one face, facing the cover member side, of the board, it is unnecessary to use a lead for connecting the tact switch and the printed wiring of the board, and since it is unnecessary to secure a space for the lead to be routed it is possible to reduce the size of the operating handle, thus enhancing the degree of freedom in design. Moreover, since the hold-down member sandwiching the flange part of the switch cover covering the tact switch between itself and the board may be engaged with the handle main body, it is possible to reduce the number of assembly steps and simplify the assembly operation, and since the hold-down member restricts the push-in stroke of the operating button to a predetermined value or below, it is possible to prevent an excessive pressing load from acting on the tact switch. Moreover, since the printed wiring is disposed on a part of the board other than the one face, which faces the cover member side, of the board, it is possible to prevent asperities from occurring on the one face of the board due to the printed wiring, thus enabling the flange part of the switch cover to be in intimate contact with the one face of the board and thereby preventing water or the potting material from entering the tact switch side.

Furthermore, in accordance with the second aspect of the present invention, since the hold-down member is formed so as to integrally have the hold-down member main portion, which has on opposite end parts the hold-down face abutting against the entire periphery of the flange part and the restricting face opposing the operating button, the flange part, and the engagement claw, which is formed integrally at a plurality of locations in the peripheral direction on the outer periphery of the hold-down member main portion so as to resiliently engage with the latching projection of the handle main body, and the positioning part, which determines the fixed relative position between the engagement claw and the latching projection, is formed on at least one of the latching projection and the engagement claw, it is possible to improve the ease of assembly while preventing erroneous assembly when assembling the hold-down member onto the handle main body.

In accordance with the third aspect of the present invention, since the annular projection provided integrally with the hold-down member projects from the hold-down face so as to bite into the flange part while surrounding the tact switch, and the restricting wall projecting from the outer periphery of the restricting face so as to prevent the potting material from flowing in between the operating button and the restricting face is provided integrally with the hold-down member, it is possible to prevent the potting material from flowing into the tact switch side from between the flange portion of the switch cover and the hold-down member and to prevent the potting material from flowing in between the operating button and the restricting face, thus ensuring normal operation of the tact switch by means of a pushing operation of the operating button.

Furthermore, in accordance with the fourth aspect of the present invention, since the U-shaped groove is formed between the hold-down member main portion and the arm portion, the engagement claw being formed integrally with the extremity of the arm portion, due to the potting material flowing into the groove the engaged state of the engagement claw with the latching projection can be maintained, and the engaged state of the hold-down member with the handle main body is not released even when an external force acts on the hold-down member.

EXPLANATION OF REFERENCE NUMERALS AND SYMBOLS

Figure 1:
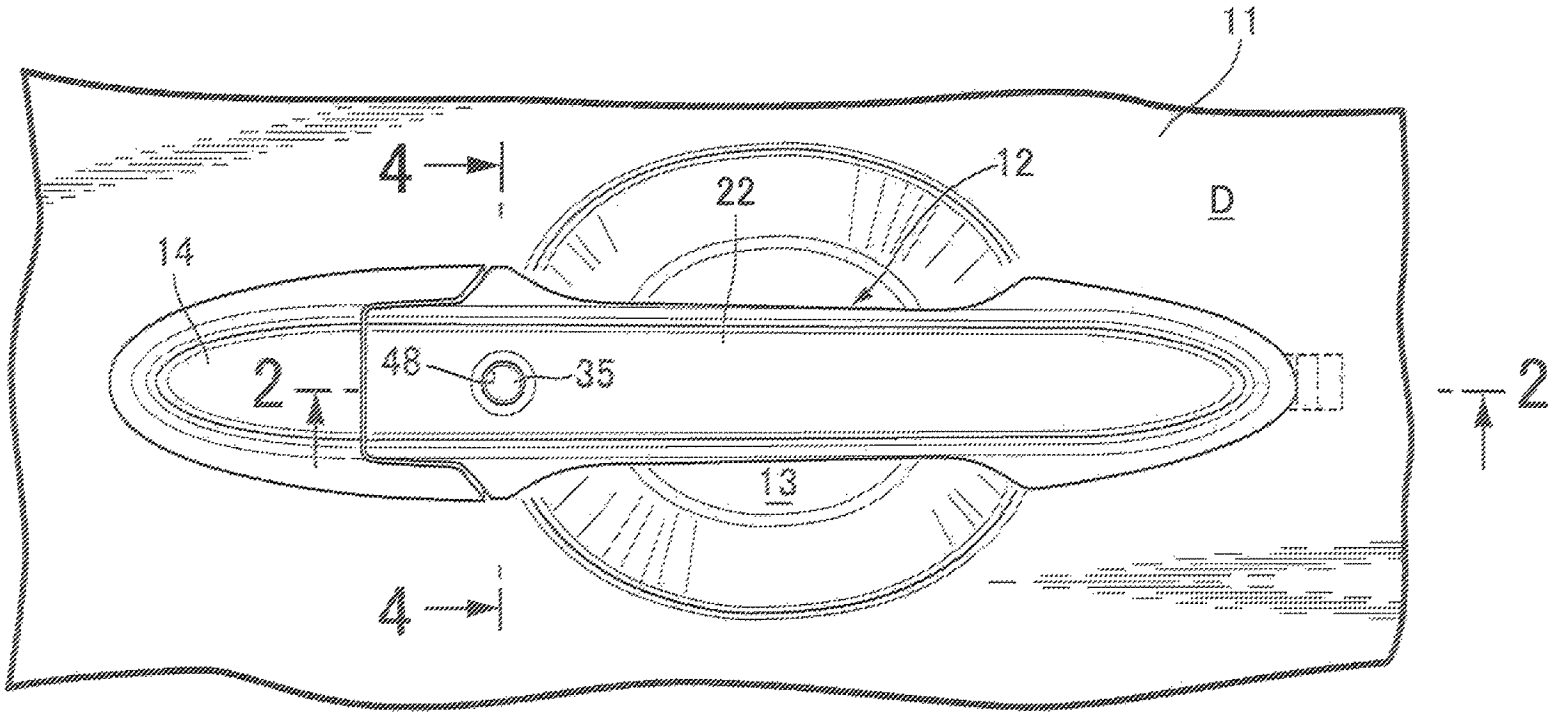
FIG. 1 is a side view of a vehicle door. (first embodiment)

12 Operating handle
21 Handle main body
22 Cover member
28 Housing recess
30 Electronic component
31 Board
31*a* One face of board
32 Tact switch
33, 34 Printed wiring
35 Operating button
36 Switch cover
36*b* Flange portion
38 Hold-down member
38*a* Hold-down member main portion
38*b* Engagement claw
38*c* Arm portion
38*d* Annular projection
38*e* Restricting wall
39 Hold-down face
40 Restricting face
41 Latching projection
42 Groove
43 Positioning part
47 Potting material
D Vehicle door

MODE FOR CARRYING OUT THE INVENTION

An embodiment of the present invention is explained by reference to FIG. 1 to FIG. 7.

First Embodiment

Figure 2:
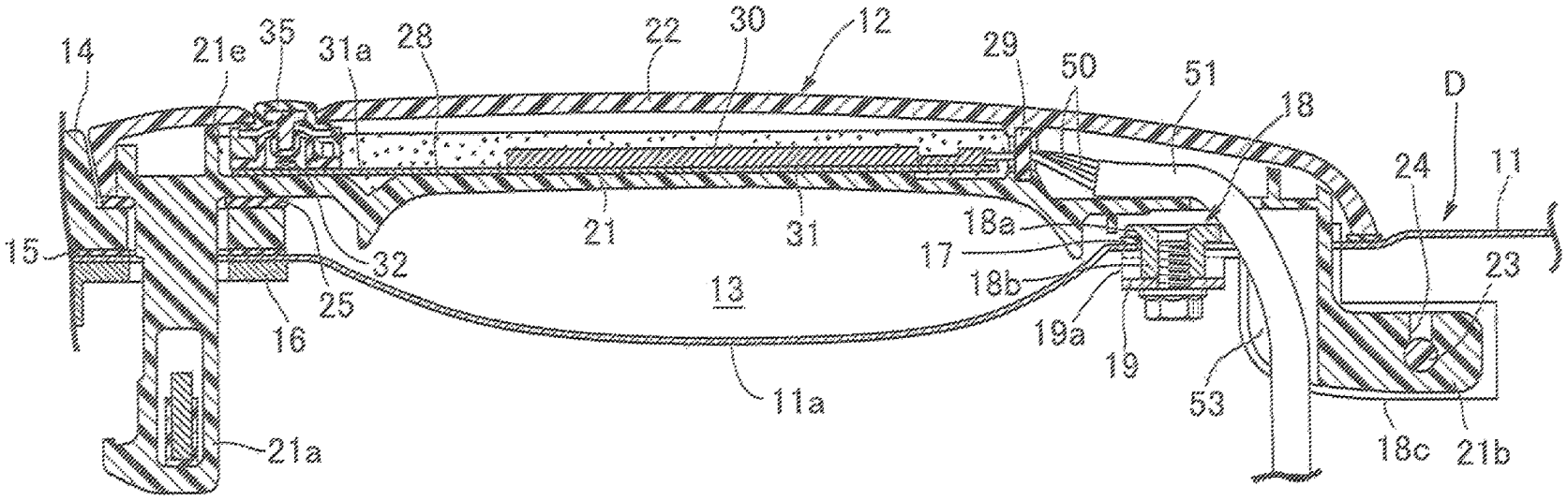
FIG. 2 is a sectional view along line 2-2 in FIG. 1. (first embodiment)

First, in FIG. 1 and FIG. 2, an operating handle 12 extending in the fore-and-aft direction of a vehicle (the left-and-right direction in FIG. 1) is pivotably mounted on an outer panel 11 of a vehicle door D, which is for example a side door, so that the operating handle 12 can be operated from outside the vehicle door D. Also provided on the outer panel 11 so as to protrude inward in the vehicle width direction is a curved portion 11*a* forming a depression 13 that enables the hand of a vehicle user holding the operating handle 12 to be inserted.

Disposed to the rear of the operating handle 12 in the fore-and-aft direction of the vehicle so that a seal member 15 is disposed between itself and an outer face of the outer panel 11 is a rear base member 14 protruding outward from the outer panel 11 so as to be smoothly connected to the operating handle 12 in a non-operated state. This rear base member 14 is secured to the outer panel 11 together with a first mounting member 16 abutting against an inner face of the outer panel 11.

A front base member 18 made of a synthetic resin is disposed at a position that overlaps a front part of the operating handle 12 along the fore-and-aft direction of the vehicle when viewed from the side, the front base member 18 having a flat plate-shaped mounting portion 18*a* having a seal member 17 disposed between itself and the outer face of the outer panel 11, and a cylindrical boss portion 18*b* integrally connected to the mounting portion 18*a* so as to extend through the seal member 17 and the outer panel 11 and penetrate into the outer panel 11. A second mounting member 19 having a substantially U-shaped form while having a pair of leg portions 19*a* abutting against the inner face of the outer panel 11 is disposed so as to straddle the boss portion 18*b*, and the front base member 18 and the second mounting member 19 are fixed to the outer panel 11 by screwing and tightening a bolt 20 inserted through the second mounting member 19 into the boss portion 18*b*. Furthermore, a support portion 18*c* bent into a substantially L-shaped form is provided integrally with a front part of the front base member 18 so as to penetrate into the outer panel 11.

Figure 3:
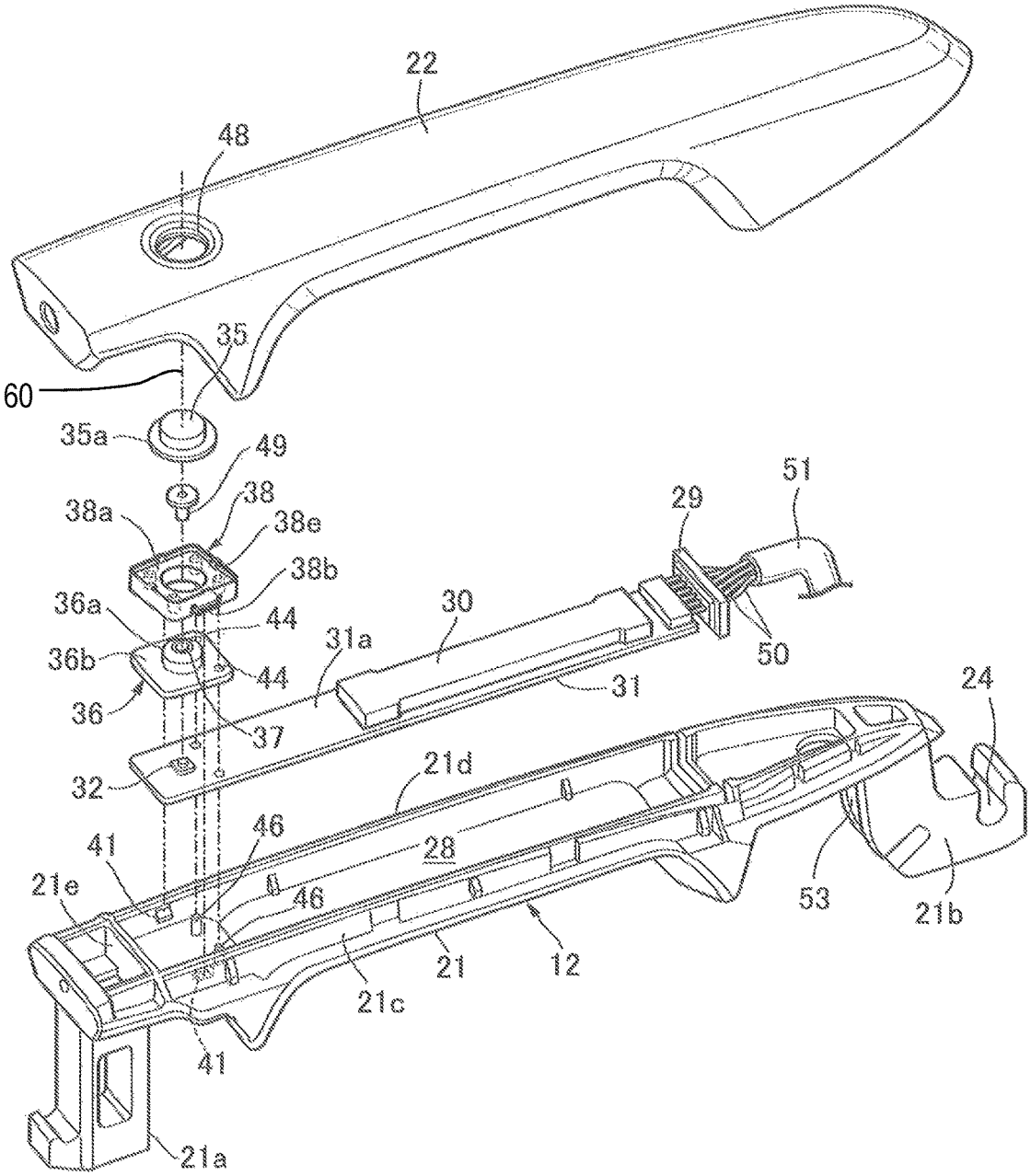
FIG. 3 is an exploded perspective view of an operating handle. (first embodiment)
Figure 4:
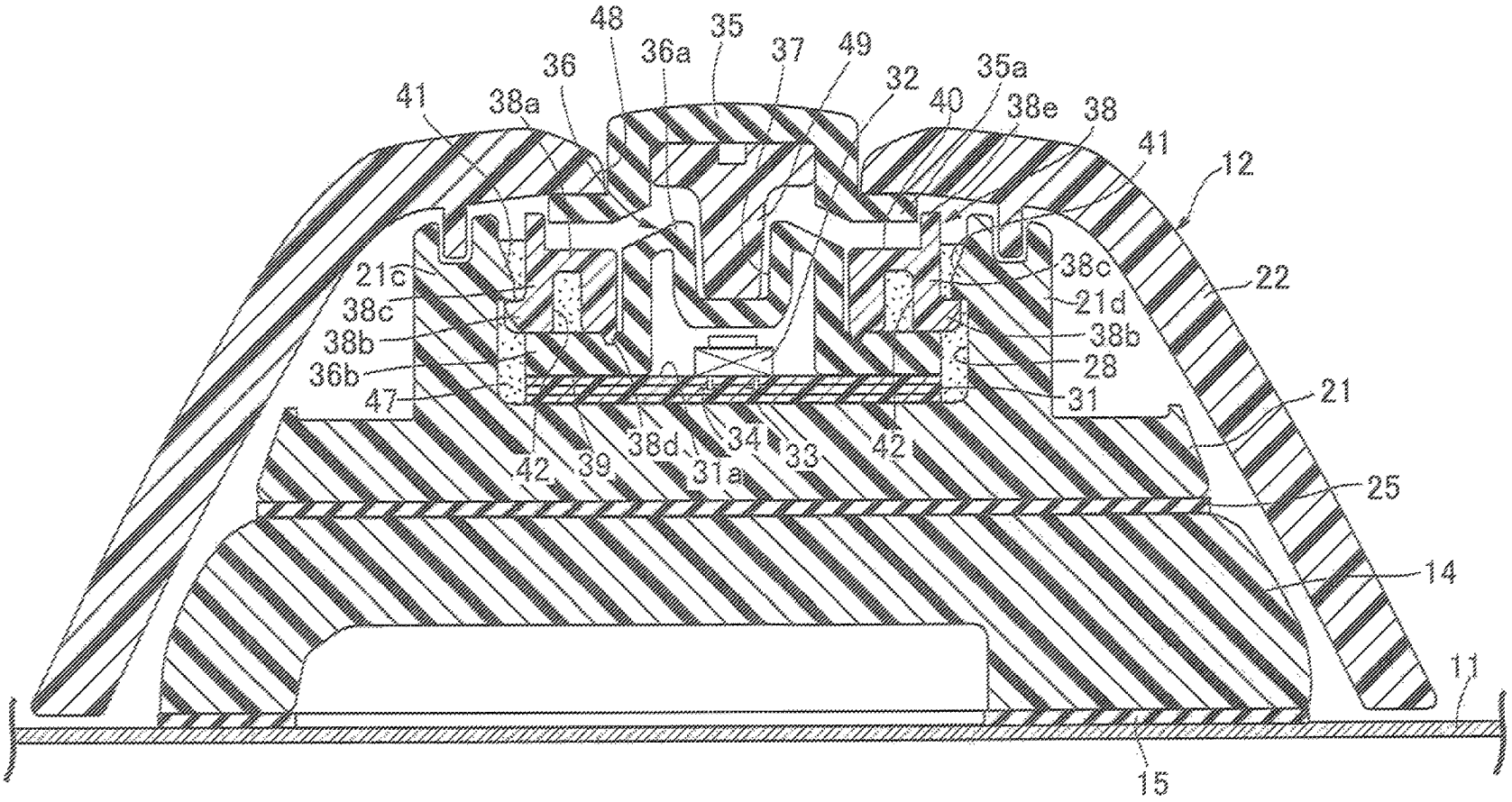
FIG. 4 is an enlarged sectional view along line 4-4 in FIG. 1. (first embodiment)
Figure 5:
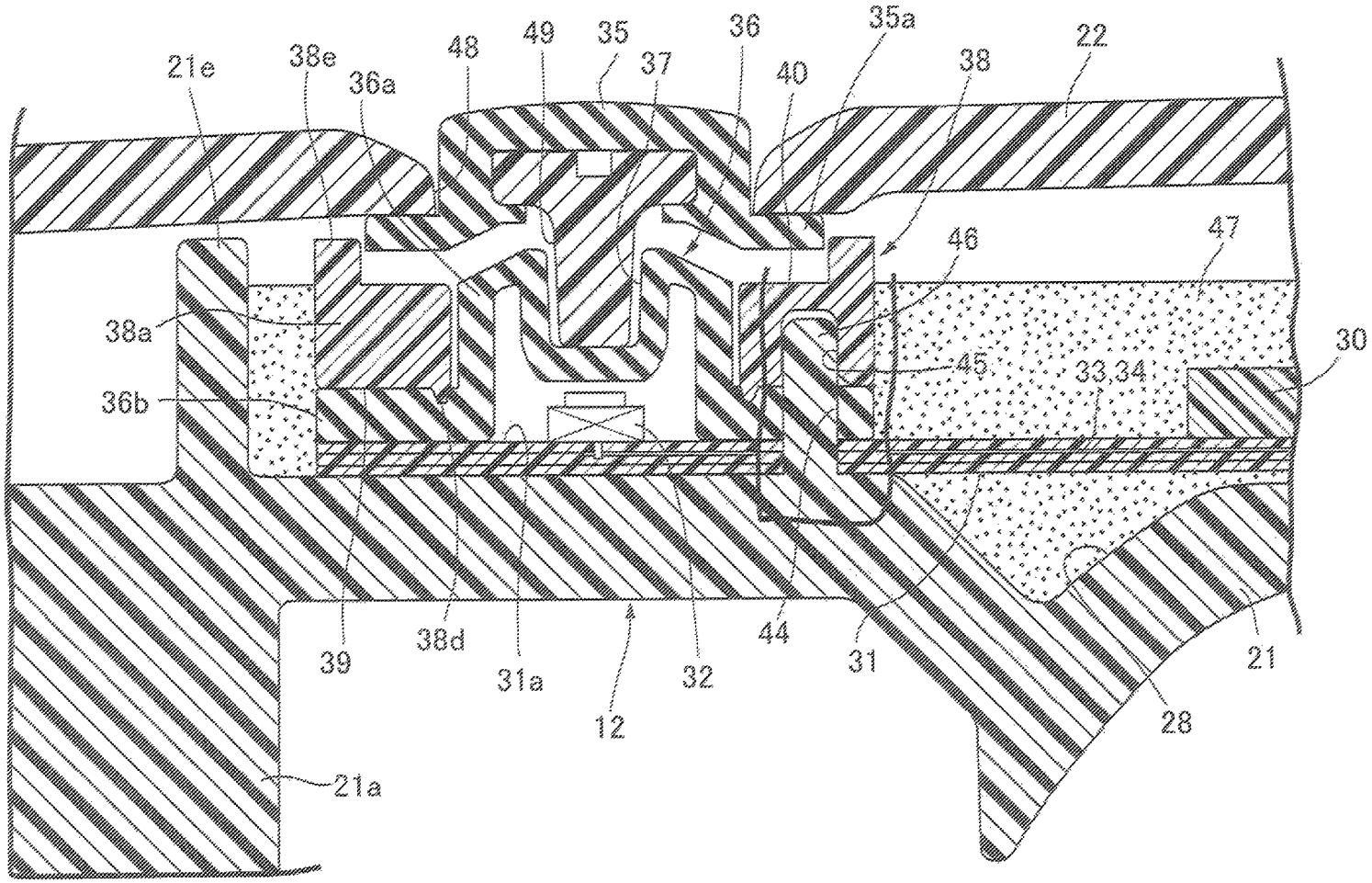
FIG. 5 is an enlarged view of an essential part in FIG. 2. (first embodiment)

Referring in addition to FIG. 3 to FIG. 5, the operating handle 12 is formed by joining to each other a handle main body 21 formed from a synthetic resin, extending in the fore-and-aft direction of the vehicle, and disposed on the outer face side of the outer panel 11, and a cover member 22 made of a synthetic resin and covering the handle main body 21 from the side opposite to the vehicle door D.

An operating arm portion 21*a* is provided integrally with a rear end part of the handle main body 21, the operating arm portion 21*a* extending through the rear base member 14, the seal member 15, the outer panel 11, and the first mounting member 16 and penetrating into the outer panel 11. A support arm portion 21*b* having a substantially L-shaped form is provided integrally with a front end part of the handle main body 21, the support arm portion 21*b* penetrating into the support portion 18*c* of the front base member 18.

A support recess 24 is provided at the extremity of the support arm portion 21*b*, the support recess 24 being fitted from below onto a support shaft 23 provided on the support portion 18*c* of the front base member 18, and fitting the support recess 24 onto the support shaft 23 pivotably supports the support arm portion 21*b* on the support portion 18*c* of the front base member 18.

Furthermore, the operating arm portion 21*a* is linked to a latch mechanism, which is not illustrated, and when the vehicle door D is in an unlocked state, operating the operating handle 12 in a direction in which the operating arm portion 21*a* is pulled outside the vehicle door D makes the latch mechanism release a closed state of the vehicle door D, and the vehicle door D can be opened by operation of the operating handle 12. Moreover, the operating handle 12 is urged by means of urging means, which is not illustrated, toward the side on which the operating arm portion 21*a* is pulled inside the vehicle door D, and an elastic member 25 surrounding the operating arm portion 21*a* is fitted onto the operating arm portion 21*a* so as to alleviate the impact when abutting against the rear base member 14.

The handle main body 21 has a housing recess 28 that has a substantially U-shaped cross-sectional shape opening on the side opposite to the vehicle door D and that is covered with the cover member 21. The housing recess 28 is formed in the handle main body 21 so that its peripheral wall is defined by a pair of side wall portions 21*c* and 21*d* provided integrally with the handle main body 21 so as to extend along the longitudinal direction of the handle main body 21 and oppose each other, a linking wall portion 21*e* provided integrally with the handle main body 21 so as to join the two side wall portions 21*c* and 21*d* in a part corresponding to the operating arm portion 21*a*, and a grommet 29 retained between the handle main body 21 and the cover member 22 so as to be disposed across the area between the two side wall portions 21*c* and 21*d* to the rear of the support arm portion 21*b*.

A board 31 having an electronic component 30 such as an antenna unit mounted thereon is housed and fixed within the housing recess 28, and a tact switch 32 is fixed to a rear part of one face 31*a*, facing the cover member 22 side, of the board 31, the tact switch 32 functioning as a lock switch for confirming for example the intention of a vehicle user to lock the vehicle door D.

The tact switch 32 is electrically connected to printed wiring 33, 34 of the board 31. This printed wiring 33, 34 is disposed at sites that are different from the one face 31*a*, facing the cover member 22 side, of the board 31; in this embodiment the board 31 is formed as multiple layers, and the printed wiring 33, 34 is disposed between layers of the board 31, but the printed wiring 33, 34 may be disposed on a face on the side opposite to the one face 31*a*.

The tact switch 32 can switch between switching modes in response to a pushing operation of an operating button 35 looking out on an outer surface of the cover member 22; the tact switch 32 is covered with a switch cover 36 connected to the operating button 35 so as to transmit the pushing force to the tact switch 32 in response to a pushing operation of the operating button 35, the switch cover 36 being formed from an elastic material, for example rubber.

The switch cover 36 integrally has a cover main body portion 36*a* formed with a bottomed cylindrical shape so as to cover the tact switch 32, and a flange portion 36*b* extending endlessly so as to surround, from the periphery, the tact switch 32 and a site where the tact switch 32 is connected to the printed wiring 33, 34. The flange portion 36*b* extends radially outwardly from the open end of the cover main portion 36*a*, so as to abut against the one face 31*a* of the board 31. An inward recess 37 is formed at a center portion of the blocked end of the cover main portion 36*a*, and the blocked end of the switch cover 36, proximate the recess 37, can selectively abut against the tact switch 32. The main body portion 36*a* of the switch cover 36 has an axis 60 (FIG. 3) which passes through the center portion of the blocked end thereof. The flange portion 36*b* is formed into a square shape.

The flange portion 36*b* of the switch cover 36 is fixed to the board 31 by being sandwiched between the board 31 and a hold-down member 38 that is engaged with the handle main body 21 from the board 31 side.

Figure 6:
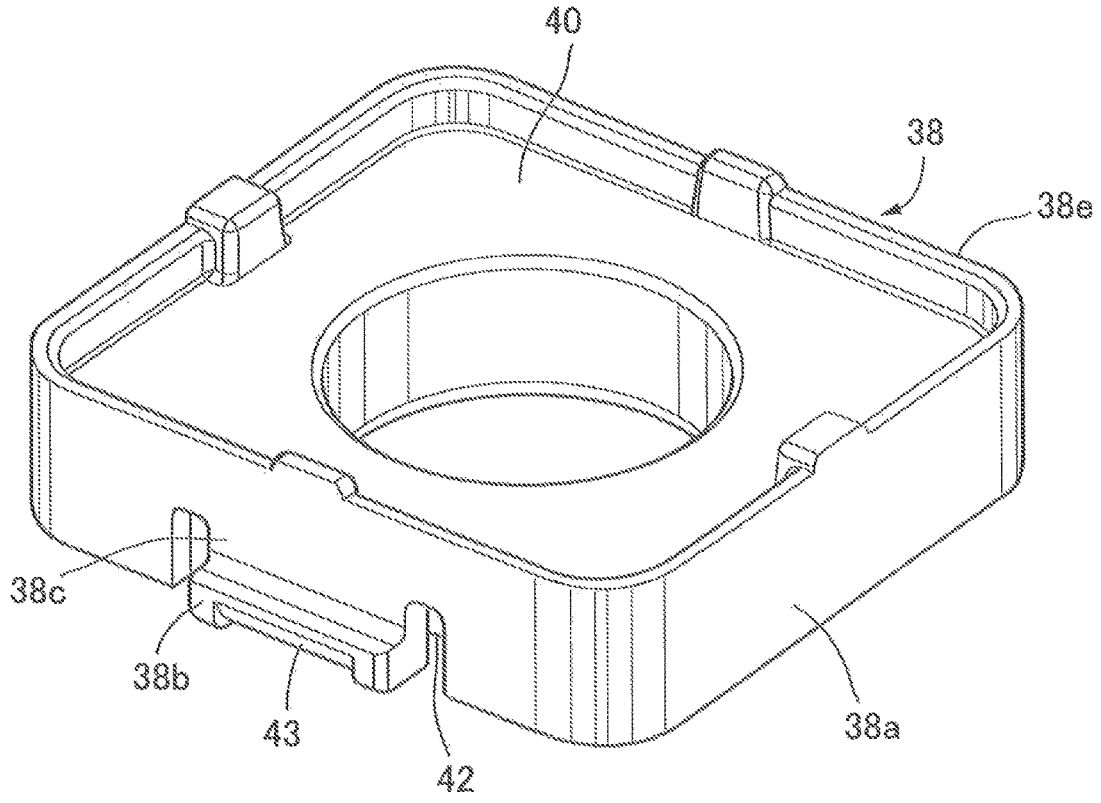
FIG. 6 is a perspective view when a hold-down member is viewed from an operating button side. (first embodiment)
Figure 7:
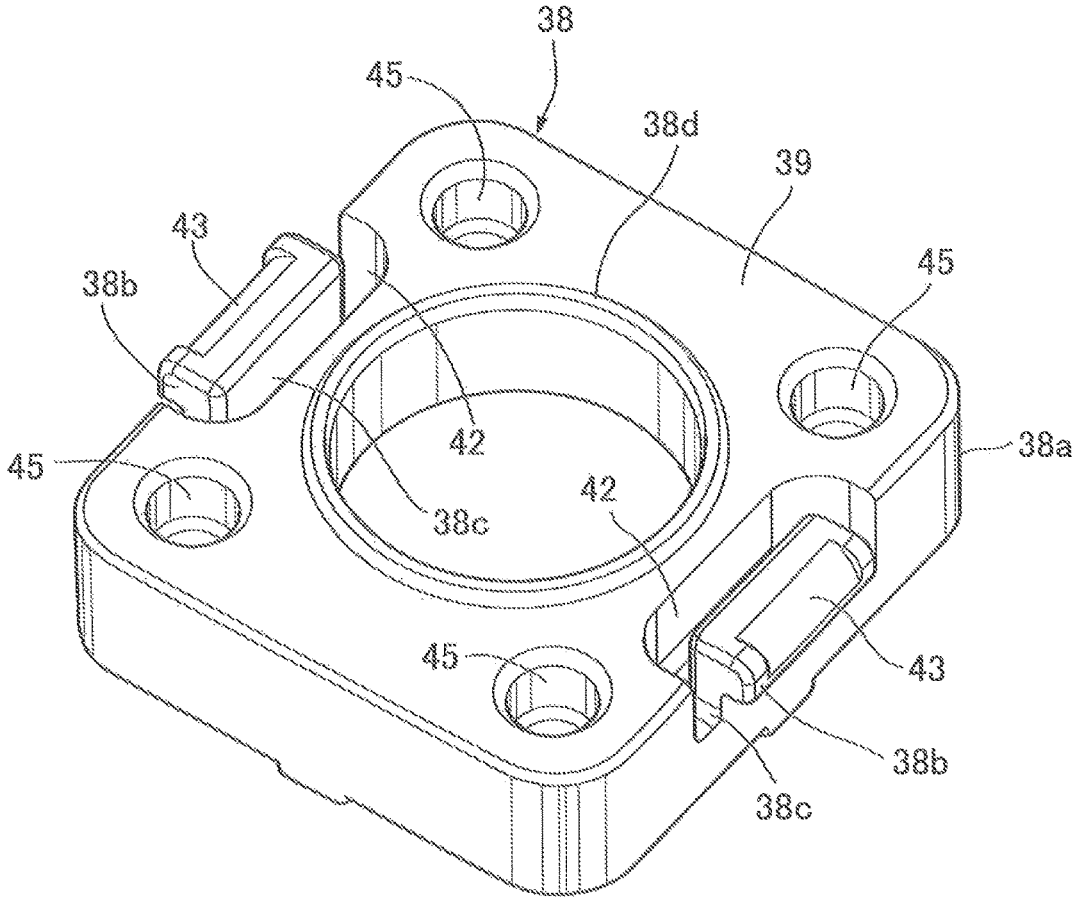
FIG. 7 is a perspective view when the hold-down member is viewed from the side opposite to that in FIG. 6. (first embodiment)

Referring in addition to FIG. 6 and FIG. 7, the hold-down member 38, which is made of a synthetic resin, is formed so as to integrally have a tubular hold-down member main portion 38*a* having a square cross-sectional external shape and engagement claws 38*b* and 38*b* integrally and connectedly provided at a plurality of locations, for example two locations, in the peripheral direction on the outer periphery of the hold-down member main portion 38*a*. The hold-down member main portion 38*a* has on opposite end parts a hold-down face 39 abutting against the entire periphery of the flange portion 36*b* of the switch cover 36 and a restricting face 40 opposing the operating button 35 so as to restrict the push-in stroke of the operating button 35, and houses part of the switch cover 36 other than the flange portion 36*b*. The engagement claws 38*b* and 38*b* can resiliently engage with latching projections 41 and 41 provided integrally with the two side wall portions 21*c* and 21*d* of the handle main body 21.

Base end parts of arm portions 38*c* and 38*c* forming U-shaped grooves 42 and 42 between themselves and the hold-down member main portion 38*a* are integrally and connectedly provided on the hold-down member main portion 38*a*, and the engagement claws 38*b* and 38*b* are formed integrally with extremities of the arm portions 38*c* and 38*c*.

A positioning part 43 is formed on at least one of the latching projection 41 and the engagement claw 38*b*, in this embodiment the engagement claw 38*b*, the positioning part 43 defining a fixed relative position between the engagement claw 38*b* and the latching projection 41 when the hold-down member 38 is inserted into the housing recess 28 and engaged with the handle main body 21. In this embodiment, the positioning part 43 is formed from a recess formed in the engagement claw 38*b* so that part of the latching projection 41 fits thereinto and is guided thereby.

A positioning hole 44 is provided in each of two corners among four corners of the flange portion 36*b* of the switch cover 36, and a bottomed positioning recess 45 is provided in four corners of the hold-down member main portion 38*a* of the hold-down member 38. On the other hand, a pair of positioning projections 46 extending through the board 31 are integrally and projectingly provided on the handle main body 21, these positioning projections 46 being fitted into the two positioning holes 44 of the flange portion 36*b* and two of the four positioning recesses 45 of the hold-down member 38, thereby positioning the switch cover 36 and the hold-down member 38 relative to the handle main body 21.

The interior of the housing recess 28 is filled with a potting material 47 in a state in which the board 31 is housed and fixed within the housing recess 28 and the flange portion 36*b* of the switch cover 36 covering the tact switch 32 fixed to the board 31 is sandwiched between the board 31 and the hold-down member 38 engaged with the handle main body 21. In order to prevent the potting material 47 from flowing into the tact switch 32 side from between the flange portion 36*b* of the switch cover 36 and the hold-down member 38, an annular projection 38*d* biting into the flange portion 36*b* so as to surround the tact switch 32 is provided integrally with the hold-down member 38 so as to project from the hold-down face 39, and in order to prevent the potting material 47 from flowing in between the operating button 35 and the restricting face 40, a restricting wall 38*e* extending endlessly while surrounding the restricting face 40 is provided integrally so as to project from the outer periphery of the restricting face 40 toward the operating button 35 side.

The operating button 35 is formed into a bottomed short cylindrical shape so as to be disposed in a circular opening 48 provided in the cover member 22, and a restricting collar portion 35*a* is integrally formed at the open end of the operating button 35, the restricting collar portion 35*a* preventing the operating button 35 from coming out of the opening 48 by abutting against an inner face of the cover member 22 around the opening 48.

Fixed to the operating button 35 is one end part of a transmission shaft 49. The other end part of the transmission shaft 49 is fitted into the recess 37 of the cover main portion 36*a* of the switch cover 36 and is connected to the switch cover 36, the pushing force of the operating button 35 being transmitted to the tact switch 32 via the transmission shaft 49 and the switch cover 36.

A plurality of leads 50 are fed out from the front part of the board 31, and these leads 50 are bundled as a harness 51. Moreover, the grommet 29 is retained between the handle main body 21 and the cover member 22 in front of the board 31, and the leads 50 are individually inserted through and retained by the grommet 29.

The harness 51 is led out toward the interior of the outer panel 11 through a lead-out groove 53 provided in the support arm portion 21*b* connected integrally to the front end part of the handle main body 21.

The operation of this embodiment is now explained. Since the board 31 is housed and fixed within the housing recess 28 possessed by the handle main body 21, which forms the operating handle 12 together with the cover member 22, and is covered with the cover member 22, and the tact switch 32 fixed to the one face 31*a* of the board 31 is electrically connected to the printed wiring 33, 34 disposed on the board 31, it is unnecessary to use a lead for connecting the printed wiring 33, 34 of the board 31 and the tact switch 32, and it is unnecessary to ensure that there is space for the lead to be routed, thus enabling the size of the operating handle 12 to be reduced and thereby enhancing the degree of freedom in design.

Furthermore, since the flange portion 36*b* extending endlessly so as to surround, from the periphery, the tact switch 32 and the site where the tact switch 32 is connected to the printed wiring 33, 34 and abutting against the one face 31*a* of the board 31 is provided integrally with the switch cover 36, made of an elastic material, covering the tact switch 32 while being connected to the operating button 35 so as to transmit the pushing force to the tact switch 32 in response to the pushing operation of the operating button 35, and the hold-down member 38 sandwiching the flange portion 36*b* between itself and the board 31 and restricting the push-in stroke of the operating button 35 to a predetermined value or below engages with the handle main body 21 from the board 31 side, it is possible to decrease the number of assembly steps and simplify the assembly operation, and it is possible to prevent an excessive pushing load from acting on the tact switch 32 due to the hold-down member 38 restricting the push-in stroke of the operating button 35 to a predetermined value or below.

Moreover, due to the printed wiring 33, 34 being disposed on the board 31 at a site different from the one face 31*a* facing the cover member 22 side, it is possible to prevent asperities from occurring on the one face 31*a* of the board 31 due to the printed wiring 33, 34, thus enabling the flange portion 36*b* of the switch cover 36 to be in intimate contact with the one face 31*a* of the board 31, and thereby preventing water or the potting material 47 from entering the tact switch 32 side.

Furthermore, since the hold-down member 38, made of a synthetic resin, is formed so as to integrally have the hold-down member main portion 38*a*, which is formed into a tubular shape while having on opposite end parts the hold-down face 39 abutting against the entire periphery of the flange portion 36*b* and the restricting face 40 opposing the operating button 35 so as to restrict the push-in stroke of the operating button 35 and while housing part of the switch cover 36 other than the flange portion 36*b*, and the engagement claw 38*b*, which is integrally and connectedly provided at the plurality of locations in the peripheral direction on the outer periphery of the hold-down member main portion 38*a* so as to resiliently engage with the latching projection 41 provided on the handle main body 21, and the positioning part 43, which determines the fixed relative position between the engagement claw 38*b* and the latching projection 41 when the hold-down member 38 is inserted into the housing recess 28 and engaged with the handle main body 21, is formed on at least one of the latching projection 41 and the engagement claw 38*b* (in this embodiment the engagement claw 38*b*), it is possible to improve the ease of assembly while preventing erroneous assembly when assembling the hold-down member 38 onto the handle main body 21.

Moreover, since the annular projection 38*d* biting into the flange portion 36*b* so as to surround the tact switch 32 is provided integrally with the hold-down member 38 so as to project from the hold-down face 39, and the restricting wall 38*e* extending endlessly while surrounding the restricting face 40 so as to prevent the potting material 47, with which the housing recess 28 is filled, from flowing in between the operating button 35 and the restricting face 40 is provided integrally so as to project from the outer periphery of the restricting face 40 toward the operating button 35 side, it is possible to prevent the potting material 47 from flowing into the tact switch 32 side from between the flange portion 36*b* of the switch cover 36 and the hold-down member 38 and to prevent the potting material 47 from flowing in between the operating button 35 and the restricting face 40, thus ensuring normal operation of the tact switch 32 by means of a pushing operation of the operating button 35.

Furthermore, since the base end part of the arm portion 38*c* forming the U-shaped groove 42 between itself and the hold-down member main portion 38*a* is integrally and connectedly provided on the hold-down member main portion 38*a*, and the engagement claw 38*b* is formed integrally with the extremity of the arm portion 38*c*, due to the potting material 47 flowing into the groove 42, the engaged state of the engagement claw 38*b* with the latching projection 41 can be maintained, and the engaged state of the hold-down member 38 with the handle main body 21 is not released even when an external force acts on the hold-down member 38.

An embodiment of the present invention is explained above, but the present invention is not limited to the above embodiment and may be modified in a variety of ways as long as the modifications do not depart from the spirit and scope thereof.

For example, in the above embodiment, the operating button 35 is connected to the switch cover 36 via the transmission shaft 49, but an operating button may be formed so as to directly abut against a switch cover. In this case, positioning of the operating button may be carried out by means of the restricting wall 38*e* of the hold-down member 38, and by so doing when carrying out assembly of the operating handle 12 it becomes unnecessary, by positioning the operating button by means of the restricting wall 38*e* of the hold-down member 38, to carry out confirmation of positioning, thus contributing to improvement of the ease of assembly.

The invention claimed is:

1. A handle device configured for installation on a vehicle door, so as to be operable on an outer face side of the vehicle door when installed thereon, the handle device comprising:

a handle main body having a housing recess formed therein for housing and fixing a board having an electronic component mounted thereon;

a cover member joined to the handle main body so as to cover the housing recess;

a tact switch configured to switch between switching modes in response to a pressing-in operation of an operating button projected outwardly from an outer surface of the cover member, the tact switch being housed and fixed within the housing recess so as to be electrically connected to printed wiring of the board; the tact switch, which is fixed to one face of the board facing the cover member side, being electrically connected to the printed wiring, which is disposed at a different site from said one face of the board;

a switch cover including a flange portion and a substantially cylindrical main body portion with a blocked end, an inward recess being formed at a center portion of the blocked end configuring the blocked end to project inwardly toward, and selectively abut against the tact switch, the main body portion having an axis which passes through the center portion of the blocked end thereof, the flange portion extending outwardly in a direction substantially perpendicular to the axis of the substantially cylindrical main body portion to form a plate shape on the switch cover, and configured so as to surround a periphery of the tact switch and a site where the tact switch is connected to the printed wiring, and abut against said one face of the board, the switch cover being made of an elastic material, covering the tact switch, and being configured to engage the operating button so as to transmit a pushing force to the tact switch in response to a pushing operation of the operating button; and a hold-down member which is formed separately from other parts of the handle device, the hold-down member configured to sandwich the flange portion of the switch cover between itself and the board, and restrict a push-in stroke of the operating button to a predetermined value or below, and be engaged with the handle main body from the board side;

wherein the hold-down member, which is made of a synthetic resin, comprises a hold-down member main portion having, on opposite end parts, a hold-down face abutting against the entire periphery of the flange portion and a restricting face opposing the operating button in order to restrict the push-in stroke of the operating button, wherein an annular projection, biting into the flange portion so as to surround the tact switch, is provided integrally with the hold-down member so as to project from the hold-down face, and wherein an interior of the housing recess is filled with a potting material.

2. The handle device according to claim 1, wherein the hold-down member houses part of the switch cover other than the flange portion, and wherein the hold-down member further comprises a plurality of engagement claws integrally and connectedly provided at a plurality of locations in a peripheral direction of an outer periphery of the hold-down member main portion, the engagement claws configured so as to resiliently engage with a latching projection provided on the handle main body, and wherein a positioning part is formed on at least one of the latching projection and the engagement claw, the positioning part determining a fixed relative position between the engagement claw and the latching projection when the hold-down member is inserted into the housing recess so as to engage with the handle main body.

3. The handle device according to claim 2, wherein a restricting wall, extending upwardly while surrounding the restricting face so as to prevent the potting material with which the housing recess is filled from flowing in between the operating button and the restricting face, is provided integrally with the hold-down member so as to project from the outer periphery of the restricting face toward the operating button side.

4. The handle device according to claim 2, wherein a base end part of an arm portion forming a U-shaped groove between itself and the hold-down member main portion is integrally and connectedly provided on the hold-down member main portion, and the engagement claw is formed integrally with an extremity of the arm portion.

5. The handle device according to claim 3, wherein a base end part of an arm portion forming a U-shaped groove between itself and the hold-down member main portion is integrally and connectedly provided on the hold-down member main portion, and the engagement claw is formed integrally with an extremity of the arm portion.

6. A handle device configured for installation on a vehicle door, so as to be operable on an outer face side of the vehicle door when installed thereon, the handle device comprising:

a handle main body having a housing recess for housing and fixing a board having an electronic component mounted thereon;

a cover member joined to the handle main body so as to cover the housing recess;

a tact switch that can switch between switching modes in response to a pressing-in operation of an operating button looking out on an outer surface of the cover member is housed and fixed within the housing recess so as to be electrically connected to printed wiring of the board; and an interior of the housing recess is filled with a potting material, wherein:

the tact switch, which is fixed to one face, facing the cover member side, of the board, is electrically connected to the printed wiring, which is disposed at a different site from said one face of the board, a flange portion extending outwardly and configured so as to surround, from the periphery, the tact switch and a site where the tact switch is connected to the printed wiring and abutting against said one face of the board is provided integrally with a switch cover, made of an elastic material, covering the tact switch while being connected to the operating button so as to transmit a pushing force to the tact switch in response to a pushing operation of the operating button, and a hold-down member sandwiching the flange portion between itself and the board and restricting the push-in stroke of the operating button to a predetermined value or below is engaged with the handle main body from the board side;

the hold-down member, which is made of a synthetic resin, is formed so as to integrally have a hold-down member main portion that is formed into a tubular shape while having on opposite end parts a hold-down face abutting against the entire periphery of the flange portion and a restricting face opposing the operating button in order to restrict the push-in stroke of the operating button and housing the part of the switch cover other than the flange portion, and an engagement claw that is integrally and connectedly provided at a plurality of locations in a peripheral direction of an outer periphery of the hold-down member main portion so as to resiliently engage with a latching projection provided on the handle main body, and a positioning part is formed on at least one of the latching projection and the engagement claw, the positioning part determining a fixed relative position between the engagement claw and the latching projection when the hold-down member is inserted into the housing recess so as to engage with the handle main body; and an annular projection biting into the flange portion so as to surround the tact switch is provided integrally with the hold-down member so as to project from the hold-down face, and a restricting wall extending upwardly while surrounding the restricting face so as to prevent the potting material, with which the housing recess is filled, from flowing in between the operating button and the restricting face is provided integrally with the hold-down member so as to project from the outer periphery of the restricting face toward the operating button side.

7. A handle device configured for installation on a vehicle door, so as to be operable on an outer face side of the vehicle door when installed thereon, the handle device comprising:

a handle main body having a housing recess for housing and fixing a board having an electronic component mounted thereon;

a cover member joined to the handle main body so as to cover the housing recess;

a tact switch that can switch between switching modes in response to a pressing-in operation of an operating button looking out on an outer surface of the cover member is housed and fixed within the housing recess so as to be electrically connected to printed wiring of the board; and an interior of the housing recess is filled with a potting material, wherein:

the tact switch, which is fixed to one face, facing the cover member side, of the board, is electrically connected to the printed wiring, which is disposed at a different site from said one face of the board, a flange portion extending outwardly and configured so as to surround, from the periphery, the tact switch and a site where the tact switch is connected to the printed wiring and abutting against said one face of the board is provided integrally with a switch cover, made of an elastic material, covering the tact switch while being connected to the operating button so as to transmit a pushing force to the tact switch in response to a pushing operation of the operating button, and a hold-down member sandwiching the flange portion between itself and the board and restricting the push-in stroke of the operating button to a predetermined value or below is engaged with the handle main body from the board side;

the hold-down member, which is made of a synthetic resin, is formed so as to integrally have a hold-down member main portion that is formed into a tubular shape while having on opposite end parts a hold-down face abutting against the entire periphery of the flange portion and a restricting face opposing the operating button in order to restrict the push-in stroke of the operating button and housing the part of the switch cover other than the flange portion, and an engagement claw that is integrally and connectedly provided at a plurality of locations in a peripheral direction of an outer periphery of the hold-down member main portion so as to resiliently engage with a latching projection provided on the handle main body, and a positioning part is formed on at least one of the latching projection and the engagement claw, the positioning part determining a fixed relative position between the engagement claw and the latching projection when the hold-down member is inserted into the housing recess so as to engage with the handle main body; and a base end part of an arm portion forming a U-shaped groove between itself and the hold-down member main portion is integrally and connectedly provided on the hold-down member main portion, and the engagement claw is formed integrally with an extremity of the arm portion.

* * * * *